US006085403A

United States Patent [19]

Petit

[11] Patent Number: 6,085,403

[45] Date of Patent: Jul. 11, 2000

[54] METHOD OF MAKING A GANGWAY BELLOWS FOR ROLLING STOCK

[75] Inventor: Jean-Claude Petit, Mouvaux, France

[73] Assignee: Le Joint Francais S.N.C.

[21] Appl. No.: 09/343,465

[22] Filed: Jun. 30, 1999

Related U.S. Application Data

[62] Division of application No. 08/893,984, Jul. 16, 1997, Pat. No. 5,953,998.

[30] Foreign Application Priority Data

Jul. 17, 1996 [FR] France ..... 96-08932

[51] Int. Cl.[7] ..... B23P 19/04

[52] U.S. Cl. ..... 29/454; 105/8.1; 105/15; 105/18; 105/20; 280/403

[58] Field of Search ..... 29/454; 105/18, 105/20, 15, 8.1; 280/403

[56] References Cited

U.S. PATENT DOCUMENTS 2,534,124 12/1950 Hasselhorn .
5,111,752 5/1992 Carimentrand ..... 105/18

*Primary Examiner*—P. W. Echols
*Assistant Examiner*—John C. Hong
*Attorney, Agent, or Firm*—Morgan, Lewis & Bockius LLP

[57] ABSTRACT

A gangway bellows for rolling stock, where the bellows has corrugated regions forming a deformable volume, and comprises a plurality of assembled-together modules, each module being made of a rubber-base material and including at least two corrugated regions that are assembled together by vulcanization.

2 Claims, 2 Drawing Sheets

METHOD OF MAKING A GANGWAY BELLOWS FOR ROLLING STOCK

This is a division of application Ser. No. 08/893,984 filed Jul. 16, 1997, now U.S. Pat. No. 5,953,998.

The present invention relates to a gangway bellows for rolling stock, e.g. for the purpose of providing a link between two cars of a moving assembly such as a train, a tram, a bus, or any other rail or road vehicle.

BACKGROUND OF THE INVENTION

It is known that rail cars include at an end of the body proper a concertina-like bellows for interconnecting the cars and for providing protection against the weather for passengers moving between the cars.

Certain known devices make use of a riveted configuration made of leather with reinforcement made of aluminum extrusions, while other devices are built up from cloth coated on both faces with polyvinyl chloride (PVC), or with rubber, which is then cut and assembled by adhesive or stitching, and is finally reinforced around the external outline of the corrugations by aluminum extrusions that are bent to shape and crimped on.

In use, such devices are not immune from leaks due to the stitching, while their capacity for deformation remains limited because of the orientation of the textile medium, thus having the effect of leading to bellows having a large number of corrugations.

There therefore exists a problem of providing a link bellows for protection against the weather, in particular for a rail car, that is leakproof and that can accommodate relative movements between the cars while maintaining a shape that is developable in order to guarantee good lifetime.

OBJECTS AND SUMMARY OF THE INVENTION

A general aim of the present invention is to provide an advantageous solution to this problem.

Consequently, a general aim of the invention is to provide a solution to this problem and ensure excellent leakproofing.

Another aim of the invention is to provide a bellows in which the base material makes it possible to adapt to demand and to fire/smoke classifications.

Yet another aim of the invention is to make it possible to stiffen or reinforce the stiffness of certain corrugations while retaining the option of not fitting the bellows with reinforcement, and to do so without changing the outside appearance of the bellows.

It is also an aim of the invention to be able to adapt to diverse shapes and relative movements.

Another aim of the invention is to be able to use thicker materials to improve sound insulation and/or thermal insulation.

According to the invention, at least one of the above aims is achieved by a gangway bellows for rolling stock, the bellows having corrugated regions forming a deformable volume and comprising a plurality of assembled-together modules, each module being made of a material based on an elastomer such as rubber and including at least two corrugated regions that are assembled together by vulcanization.

This assembly by vulcanization also presents the major advantage of avoiding the presence of stitches which not only impede waterproofing, but also constitute zones in which dirt is retained.

Advantageously at least one module of the bellows includes at least one reinforcing element received inside at least one stiffener of the module, said stiffener being constituted by a frame of section greater than that of the remainder of the module, said stiffener being situated to extend the outside end of at least one corrugated region of the module. In particular, said stiffener interconnects two corrugating regions of the module, when the module is not an end module.

Said frame may include at least one recess suitable for housing at least one of said reinforcing elements.

Such a reinforcing element is preferably a rod made of glass and of resin, in particular epoxy resin.

Said stiffener may have an outside surface forming an external outline for the module that is generally rectangular in shape.

Said stiffener may have substantially rectilinear regions that are interconnected by corner regions.

Advantageously the reinforcement(s) is/are located solely in the substantially rectilinear regions.

In a preferred embodiment, the modules constituting the bellows have one of said stiffening frames situated at each of their longitudinal ends, and said end frames are longitudinally defined by closed outline regions, and said modules are assembled to one another at at least one end, e.g. by means of screws, so as to cause said closed outline regions to bear one against another.

Advantageously, the bellows includes a cloth or a sheet of interwoven rods embedded in said rubber-based material, at least in one zone of the module.

Said closed-outline regions may have complementary sawtooth profiles enabling good leakproofing to be ensured.

The invention also provides a method of making a weatherproof bellows as defined above, comprising the following steps:

disposing non-vulcanized sheets of rubber in a mold to form a module blank having at least two corrugated regions;

vulcanizing the module blank to obtain a module having at least two corrugated regions assembled together by vulcanization; and mechanically assembling together a plurality of said modules to make up the bellows.

In a preferred implementation, the module blank has at least one region forming a stiffener frame of section greater than that of the remainder of the blank, said stiffener frame connecting together two of said corrugated regions, and at least one reinforcing element is received inside said frame-forming region.

BRIEF DESCRIPTION OF THE DRAWINGS

Other characteristics and advantages of the invention appear more clearly on reading the following description given by way of non-limiting example and with reference to the accompanying drawings, in which.

MORE DETAILED DESCRIPTION

The gangway bellows shown in FIG. 1 is a bellows 40 for providing a corridor connection between two cars and it comprises a plurality of corrugated regions or corrugations 2 which are vulcanized into shape without stitching and without adhesive.

Figure 1A:
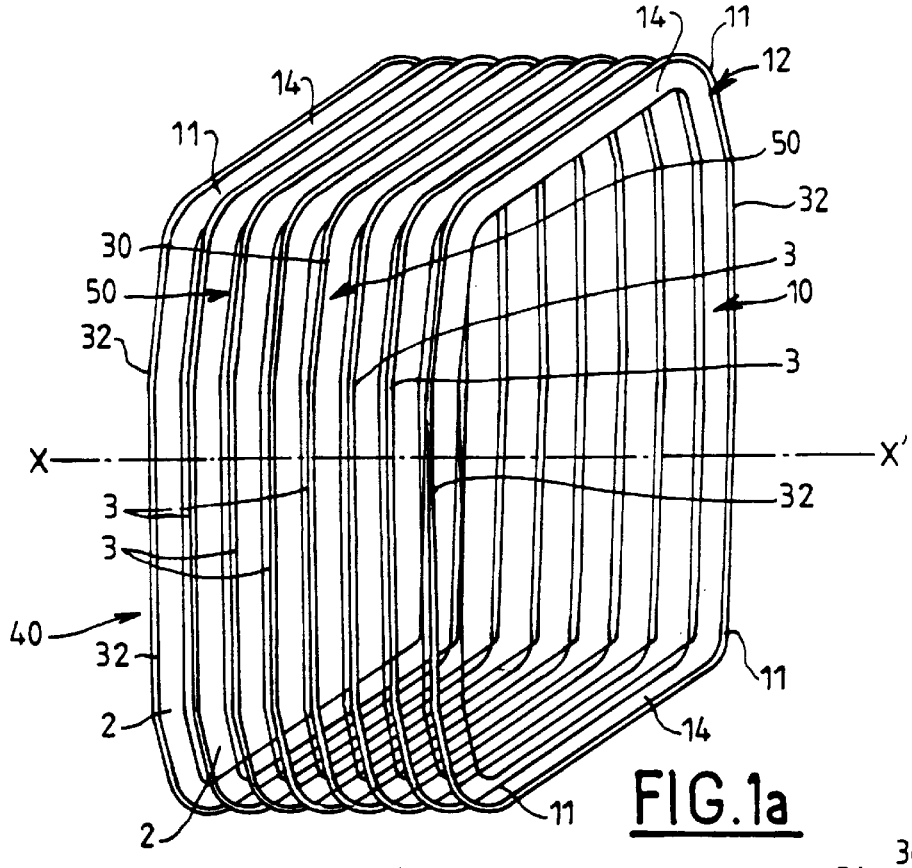
FIG. 1*a* is a perspective view of a gangway bellows of the invention.
Figure 1B:
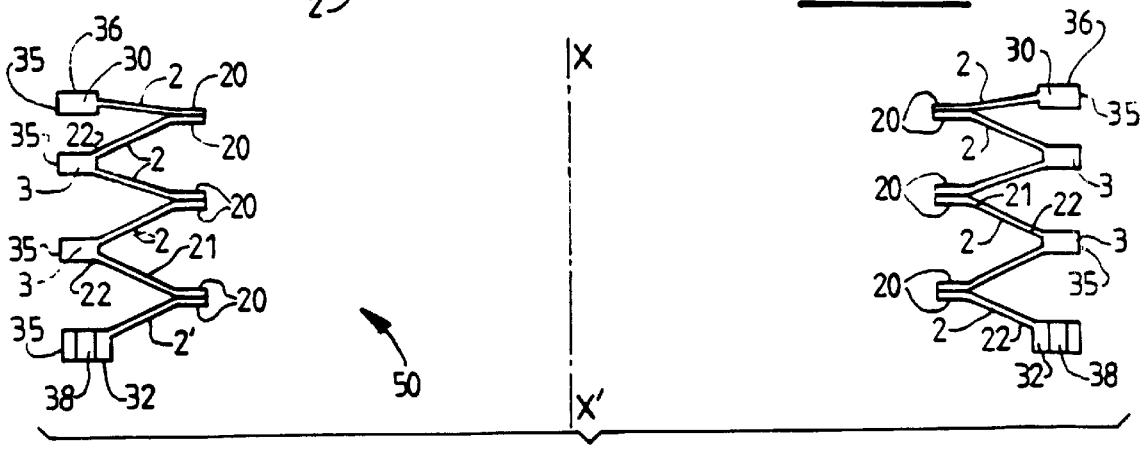
FIG. 1*b* is a section through a module of the invention on a horizontal plane including the axis XX'.
Figure 2:
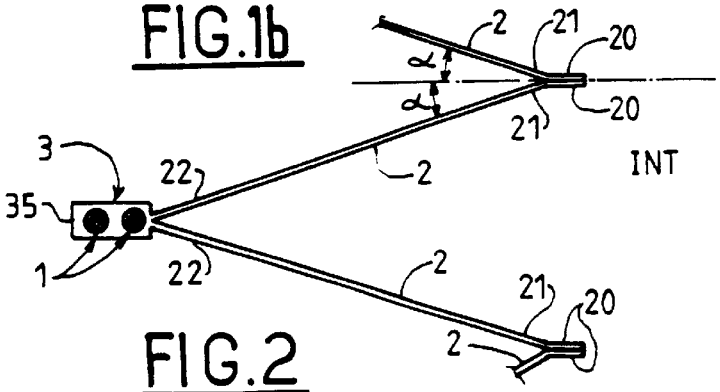
FIG. 2 is a section view of a module of the invention including an external stiffener.

As shown in FIG. 1*a* and 2, each corrugation is in the form of an inclined frame 2 which is substantially plane in section, being inclined at an angle a relative to the normal to the longitudinal axis XX' of the bellows. The inside edge 21 of the frame 2 is extended by a plane region 20 of closed outline which is vulcanized to the plane region 20 of the corrugation 2 adjacent thereto. By way of example, the module shown in FIG. 1*b* has six corrugated regions 2.

The outside edge 22 of the frame 2 is extended by an external stiffener 3 which is common to two adjacent frames 2. The stiffener 3 has a cross-sectional area that is considerably greater than that of the frame regions 2, so it is the frames 2 constituting the flexible corrugations that enable the looked-for movements to be performed. As a result, the stiffeners 3 of the bellows 40 retain their shape while the frames 2 are deforming. Said external stiffener 3 preferably includes reinforcing elements 1 such as a plurality of epoxy glass rods which are received in the external stiffener 3, for example they are embedded therein, in particular they are bonded to the material constituting the external reinforcement 3 or they are fixed thereto, e.g. by being placed in recesses provided for this purpose.

The external stiffener 3 forms an external frame about the axis XX' having an external outline 35 that is generally rectangular in shape with substantially rectilinear portions 10, 12, and 14 interconnected by corner regions 11. The reinforcements 1 are preferably disposed solely in the substantially rectilinear regions 10, 12, and 14.

By way of example, a reinforcement 1 is constituted by an epoxy glass rod having a diameter of 4 mm to 6 mm, and conventionally made from a braided glass fiber rod which is passed through an epoxy resin bath, the resin subsequently being polymerized.

The reinforcement(s) 1 of the invention make it possible to avoid using the aluminum corrugation reinforcements as used in the prior art. Such aluminum reinforcements are bent and crimped, and are complicated to implement.

Figure 3:
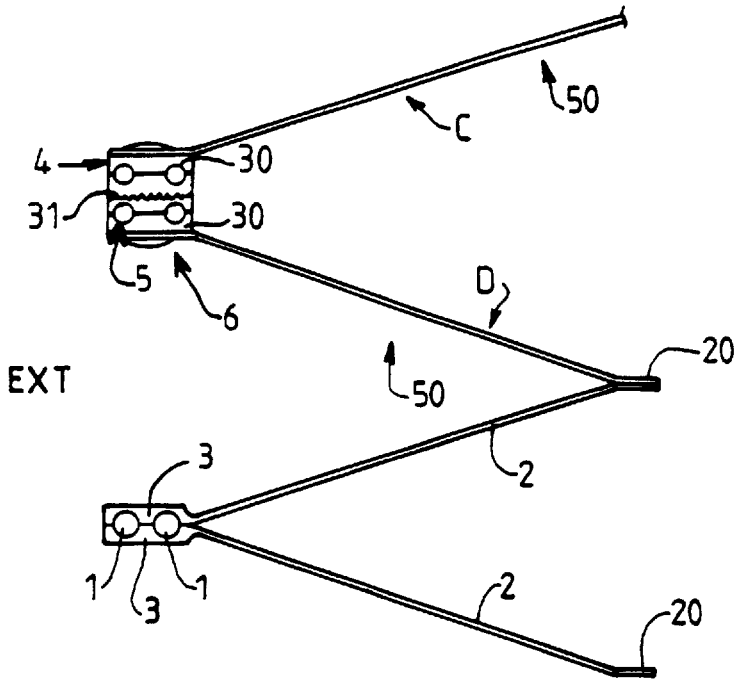
FIG. 3 shows how two modules of the invention are assembled together.

As shown in FIG. 3, the bellows 40 is built up from modules 50 placed end to end and assembled together, e.g. by means of screws 6 passing through the end external stiffeners 30. The frames 2 forming the central portion of the corrugation, the plane regions 20, and the external stiffeners 3 and 30 are made of vulcanized elastomer, e.g. rubber, and more particularly they are made of vulcanized rubberized cloth, the corrugations 2 being assembled to one another by vulcanization, said vulcanization providing mechanical cohesion and waterproofing for the frames 2 and for the external stiffeners 3.

The prior art techniques of assembly via the outline or by adhesive are thus advantageously replaced by vulcanizing the material to itself.

Each module 50 can have two end stiffeners 30 defined longitudinally by closed outline regions 36 enabling them to be assembled together, e.g. by means of screws 6. These regions 36 may have complementary profiles 31, e.g. saw-tooth profiles, to guarantee leakproofing without requiring a very large number of fixing screws 6 (see FIG. 3). The fixing screws 6 can thus be spaced apart, e.g. at intervals of 200 mm to 300 mm.

Corrugation reinforcements 1 can be combined to form a very lightweight portion presenting a module in which flexing can be varied depending on how the rods are specified and how they operate.

The corrugation reinforcement 1 may be the support for the corrugation, and can advantageously replace the cloth on its surface for creating a corrugation that behaves like a "flat" spring.

The end fixing can be secured to a stiffener 32 of larger dimensions than the stiffener 30 and bonded to the end frame 2' and pierced at 38 for fixing to the car body (see FIG. 1*b*).

In an advantageous embodiment, each end can be constituted by a metal cable fixed to the corrugation, on the outside or the inside thereof, for the purpose of fixing the bellows to a section member provided for that purpose.

In the preferred example, the bellows 40 as a whole is made up of two, or three, or even four modules 50 which are molded and vulcanized elements that are assembled together by the system whereby reference 30 constitutes the molded rubber stiffener fitted with resin-glass reinforcements 5, and the assembly made up of the modules C and D itself being assembled together by means of screws 6 (FIG. 3). FIG. 1 shows a bellows 40 made up of two modules 50.

Advantageously, the entire frame 2 can be made on the basis of a sheet 7 of epoxy glass rods for proving the frame 2 with a high degree of vertical stiffness while retaining the ability to deform. This sheet of rods comprises, for example, epoxy glass warp rods that are spaced apart at a pitch of 5 mm to 10 mm, for example, and that are held together by weft threads to form the sheet 7. The corner regions 11 may also be provided with a sheet 7.

Figure 4:
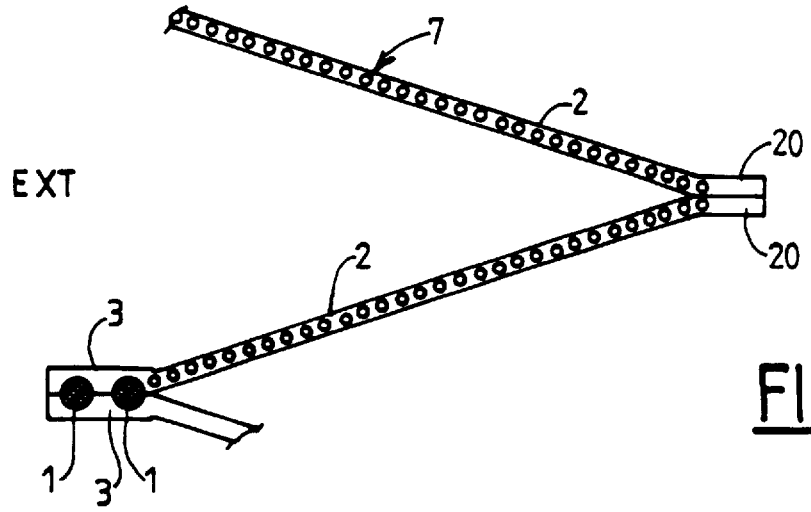
FIG. 4 shows a variant module of the invention.

As shown in FIG. 4, the sheet 7 which constitutes the reinforcement is embedded in the rubber.

In addition, the present invention is also applicable to stiffening molded or extruded sealing gaskets.

Figure 5:
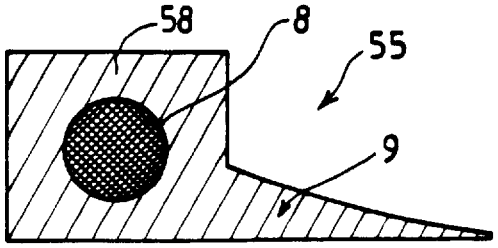
FIG. 5 is a section through a rubber section member fitted with a stiffener in accordance with a variant of the invention.

The bellows of the invention can have an end sealing gasket 55 that is molded or extruded and then subsequently bonded to the bellows (or stuck thereto with adhesive). A preferred embodiment of the gasket is shown in FIG. 5. It has a reinforcing region 58 in which one or more reinforcing elements 8 are preferably embedded, e.g. one or more resin-glass rods, and a lip 9 for providing sealing.

I claim:

1. A method of making a gangway bellows, comprising the following steps:

disposing non-vulcanized sheets of rubber in a mold to form a module blank having at least two corrugated regions;

vulcanizing the module blank to obtain a module having at least two corrugated regions assembled together by vulcanization; and mechanically assembling together a plurality of said modules to make up the bellows.

2. A method according to claim 1, wherein the module blank has at least one region forming a stiffener frame of section greater than that of the remainder of the blank, said frame-forming region connecting together two of said corrugated regions, and wherein at least one reinforcing element is received inside said frame-forming region.

* * * * *